United States Patent [19]

Kamijo

[11] 4,257,023

[45] Mar. 17, 1981

[54] DEFLECTING DEVICE FOR CATHODE-RAY TUBE

[75] Inventor: Naoyoshi Kamijo, Yokohama, Japan

[73] Assignee: Tokyo Shibaura Denki Kabushiki Kaisha, Kawasaki, Japan

[21] Appl. No.: 962,480

[22] Filed: Nov. 20, 1978

[30] Foreign Application Priority Data

Nov. 29, 1977 [JP] Japan ..... 52-142185

[51] Int. Cl.[3] ..... H01F 3/12

[52] U.S. Cl. ..... 335/211; 335/210

[58] Field of Search ..... 335/210, 211, 214

[56] References Cited

U.S. PATENT DOCUMENTS 2,227,711 1/1941 Günther ..... 335/214

3,899,761 8/1975 Yamauchi ..... 335/211

4,109,220 8/1978 Peart ..... 335/211

*Primary Examiner*—Harold Broome

*Attorney, Agent, or Firm*—Cushman, Darby & Cushman

[57] ABSTRACT

Disclosed is a deflecting device for a color cathode-ray tube which comprises a substantially tapered cylindrical core to be attached to the color cathode-ray tube, a pair of vertical deflecting coils facing each other and wound around the core to provide a barrel-distribution deflecting magnetic field, and a pair of horizontal deflecting coils inside said core for generating a pincushion-distribution deflecting magnetic field. This deflecting device further includes a correcting magnetic member arranged at the large-diameter end side of the core in the vicinity of each end of the pair of vertical deflecting coils.

8 Claims, 8 Drawing Figures

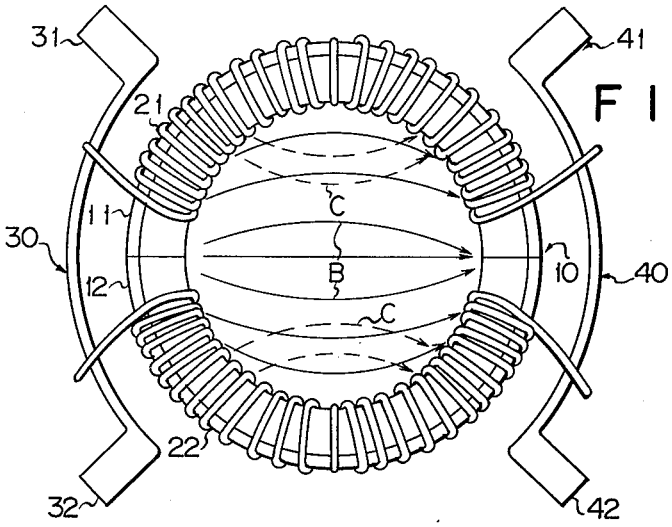
FIG. 5
FIG. 6
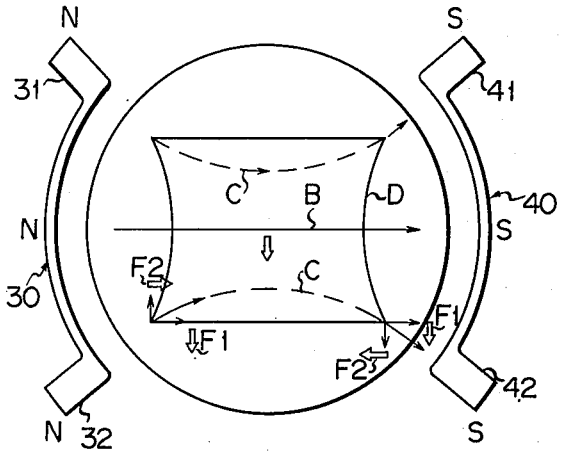
FIG. 7
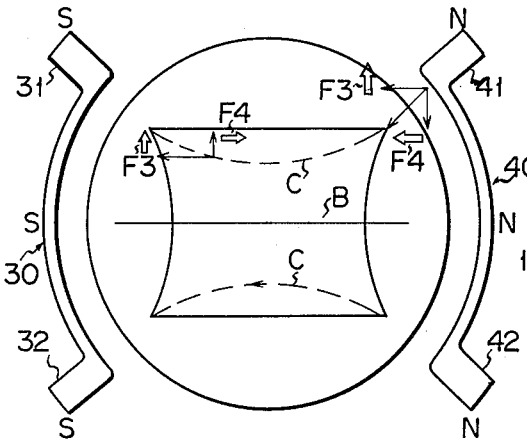
FIG. 8
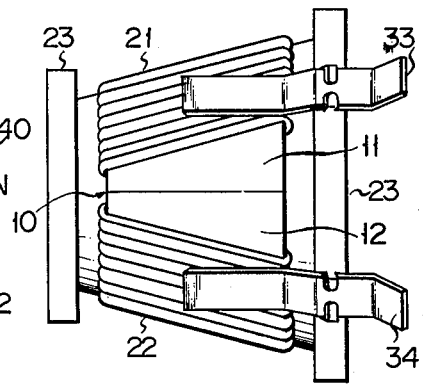

DEFLECTING DEVICE FOR CATHODE-RAY TUBE

This invention relates to a deflecting device for a color cathode-ray tube.

Heretofore, in a color television receiver using a color cathode-ray tube with an in-line electron gun assembly, vertical and horizontal deflecting coils, as shown in FIG. 1, have been so arranged as to generate barrel- and pincushion-distributed magnetic fields as indicated by solid and broken lines, respectively. In this case, the vertical deflecting coil is composed of a tapered cylindrical core 10 formed of a pair of core sections 11 and 12 and toroidal coil sections 21 and 22 wound around the respective core sections 11 and 12 as typically shown in FIG. 2, providing the barrel-distributed magnetic field as shown in FIG. 2. Further, the vertical and horizontal deflecting coils are so adjusted as to correct convergence errors of electron beams emitted from the electron gun assembly, thereby providing pictures with satisfactory convergence characteristics. Such type is generally called a self-convergence type.

In this self-convergence type deflecting device, there may be obtained satisfactory convergence characteristics of electron beams. However, since the curvature of the screen is different from the beam deflecting curvature, the raster is distorted to have a pincushion distortion on both sides as shown in FIG. 3.

At present, in order to correct the pincushion distortion, a pincushion distortion correcting circuit is used to produce in synchronism with a vertical signal an output signal which has an amplitude varied in a parabolic form and is superposed on a horizontal signal. However, such a distortion correcting circuit is inconsistent with the goal of fewer components, low cost and simple construction.

The object of this invention is to provide a deflecting device for a cathode-ray tube with a simple construction, capable of efficiently correcting raster distortions.

According to an embodiment of this invention, a deflecting device for cathode-ray tube comprises deflection means to be mounted on said cathode-ray tube and including a vertical deflection coil for generating a barrel distributed deflection magnetic field, and means for picking up leakage fluxes generated from said vertical deflection coil and causing the leakage fluxes to pass between opposite positions substantially corresponding to four corners of a screen of said cathode-ray tube, thereby deforming towards a pincushion-distributed vertical deflection magnetic field that portion of said barrel-distributed vertical deflection magnetic field which is generated in a position corresponding to the core portion of said cathode-ray tube.

This invention can be more fully understood from the following detailed description when taken in conjunction with the accompanying drawings, in which:

FIG. 5 is a diagrammatic view of a vertical-deflection magnetic field generated by the deflecting device of FIG. 4;

FIGS. 6 and 7 are diagrams for illustrating the raster distortion correcting effect of magnetic plates of the deflecting device of FIG. 4; and FIG. 8 is a side view of a self-convergence type deflecting device according to another embodiment of the invention.

Figure 1:
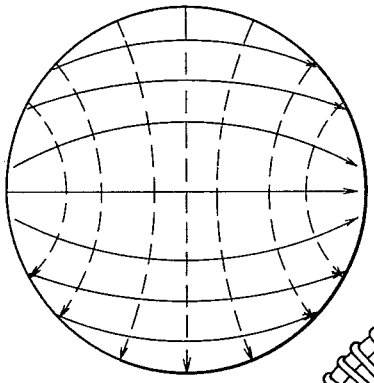
FIG. 1 PRIOR ART
FIG. 1 is a distribution diagram of vertical- and horizontal-deflection magnetic fields generated by a self-convergence type deflecting device of a color cathode-ray tube with an in-line electron gun.
Figure 2:
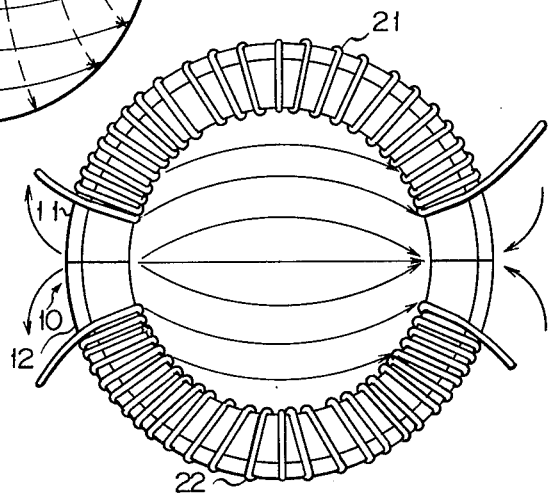
FIG. 2 PRIOR ART
FIG. 2 is a diagram for illustrating the relation between a vertical deflecting coil of the deflecting device and a vertical-deflection magnetic field formed by the vertical deflecting coil.

As explained, the barrel distributed vertical deflection magnetic field shown in FIG. 1 is generated by a pair of vertical deflection coil sections 21 and 22 toroidally wound on the tapered cylindrical core 10 shown in FIG. 2.

It is experimentally proved that a deflection yoke is formed to generate a pincushion-distributed vertical deflection magnetic field in order to correct the right and left side pincushion distortion and to generate a pincushion-distributed horizontal deflection magnetic field in order to correct the upper and lower side pincushion distortion. It is also well understood that the electron beam convergence may be decided by the total sum of barrel- or pincushion-distributed magnetic fields generated in those portions of the deflection yoke which correspond to the neck and core portions of the cathode ray tube and the raster distortion is largely dependent on the magnetic field generated in that portion which corresponds to the cone portion of the cathode ray tube.

Figure 4:
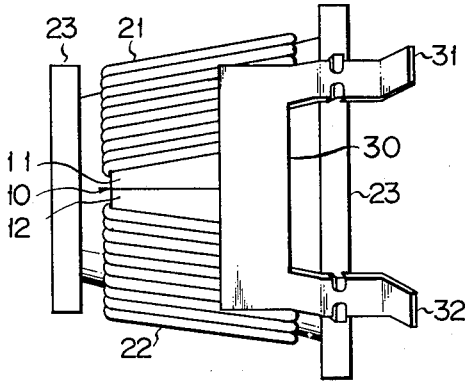
FIG. 4 is a side view of a self-convergence type deflecting device according to an embodiment of this invention.

FIG. 4 shows a self-convergence type deflecting device according to an embodiment of this invention in which the raster distortion is corrected satisfactorily in due consideration of the aforesaid circumstances. This deflecting device includes a tapered cylindrical core 10 formed of a combination of first and second core sections 11 and 12 and vertical deflecting coils 21 and 22 toroidally wound around the first and second sections 11 and 12. The tapered cylindrical core 10 is attached to the outside wall of a cylindrical support member 23 to be fitted on a cathode-ray tube (not shown) and having a gradually increasing diameter. A pair of saddle-type horizontal deflecting coils (not shown, for simplicity) are arranged opposite to each other on the inside wall of the cylindrical support member 23 by a well-known method. These saddle-type horizontal deflecting coils, in combination with the vertical deflecting coils 21 and 22, provide horizontal- and vertical-deflection magnetic fields as shown in FIG. 1.

As is clearly shown in FIG. 5, this deflecting device further includes a pair of magnetic plates 30 and 40 covering the joints of the core sections 11 and 12 at the large-diameter end side of the tapered cylindrical core 10. In these joints of the core sections 11 and 12, the strongest magnetic fields are generated from the coils 21 and 22 and magnetic fluxes set up by the coils 21 and 22 repel each other. Therefore, the magnetic plates 30 and 40 located in the joints of the core sections 11 and 12 can most efficiently pick up leakage fluxes caused by the coils 21 and 22. The magnetic plates 30 and 40 are provided, respectively, with arms 31, 32 and 41, 42 outwardly extending from the core 10 in a direction from the small-diameter end to the large-diameter end of the core 10. That is, the arms extend outwardly from that portion of the deflection device which corresponds to the cone portion of the cathode ray tube. These arms 31, 32, 41 and 42 are arranged correspondingly to the four corners of a cathode-ray tube screen.

By the use of these magnetic plates 30 and 40, fixed on the support member 23 in such positions as described above, the leakage fluxes from the vertical deflecting coils 21 and 22 are allowed to pass through the magnetic plate 30 as indicated by broken lines in FIG. 5, and generated, for example, from the arms 31 and 32 of the magnetic plate 30 to the arms 41 and 42 of the plate 40, respectively. It is to be noticed that the magnetic field provided between the arms 31 and 32 of the plate 30 and the arms 41 and 42 of the plate 40 is synchronized with the vertical-deflection magnetic field generated by the vertical deflecting coils 21 and 22, and is distributed in the pincushion form. The raster distortion may satisfactorily be eliminated by the pincushion magnetic field formed by the arms 31, 32, 41 and 42.

Now suppose that a vertical deflection magnetic field is created from left to right. Then, the left side arms 31 and 32 act as N poles and the right side arms 41 and 42 as S poles.

Figure 3:
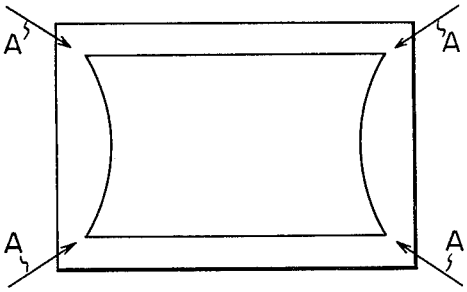
FIG. 3 PRIOR ART
FIG. 3 is a schematic diagram for illustrating raster distortion provided by a prior art self-convergence type deflecting device.

By this magnetic force a magnetic flux is created between the arms 31 and 41 and between the arms 32 and 42. This means that on the cone side a pincushion magnetic force C is created, as shown in FIG. 5, with respect to a vertical barrel magnetic field B of the deflection yoke. The pincushion magnetic field performs the following action. That is, where the magnetic field of the vertical coil deflects the beams in a plane lower than the horizontal axis, the magnetic field B of the vertical coil is formed from left to right (from the N pole side to the S pole side) as viewed from the front side of the cathode ray tube (see FIG. 6). As a result, a pincushion magnetic field C is created between the lower arms 32 and 42 and in a direction the same as that of the vertical coil magnetic field. At this time a pincushion magnetic field C is developed between the arms 32 and 42 and produces a component force F1 and component force F2 at the lower diagonal corners of the CRT screen due to the component of the magnetic flux, the component F1 pulling the beams downward and the component F2 pushing the beams inward. By the components forces F1 and F2, the lower diagonal portions of the right and left side of the pincushion distortion raster D are pushed in a direction in which the left and right portions of the pincushion distortion are decreased. Since at this time the magnetic field created between the arms 31 and 41 does not act on the beams, it imparts no substantial influence to the screen raster. Where, on the other hand, the magnetic field of the vertical coil is deflected in a plane higher than the horizontal axis, the magnetic field B of the vertical coil is formed from right to left (from the N side to the S side) as viewed from the front side of the cathode ray tube (FIG. 7). As a result, a pincushion magnetic field C is created between the upper arms 31 and 41 and in a direction the same as that of the magnetic field of the vertical coil. The pincushion magnetic field C causes a component force F3 and component force F4 in the upper diagonal corners of the CRT screen, the component force F3 pulling the beams upward and the component force F4 pushing the beams inward. By these component forces, the upper diagonal portions of the right and left sides of the pincushion distortion raster D is pushed in a direction in which the right and left portions of the pincushion distortion are decreased. At this time, the magnetic field formed between the lower arms 32 and 42 does not act upon the beams, imparting no substantial influence to the screen raster. In this way, the deformed portion of the raster is pushed in a direction as just indicated by arrows A in FIG. 3, thereby obtaining a raster having a prominently improved linearity. According to this invention, the vertical deflection magnetic field at the cone side can be varied toward the pincushion magnetic field mode and, if the barrel magnetic field of the magnetic field of the vertical deflection coil is wholly intensified by the extent corresponding to such a variation toward the pincushion magnetic field mode, only the raster distortion can be corrected without any or an appreciable influence to the convergence. Since this invention utilizes a dynamic leakage magnetic field in synchronism with the vertical deflection magnetic field, raster deformation can be corrected.

According to this invention there is no need for providing any permanent magnet etc., as well as any particular circuit and circuit parts for correction of right and left pincushion distortion, and such pincushion distortion can be effectively corrected utilizing suitable magnetic pieces on one hand and the leakage magnetic flux of the vertical deflection magnetic field on the other.

Although an illustrative embodiment of this invention has been described herein, the invention is not limited to such precise embodiment. For example, four arms may be independently arranged in positions corresponding to the four corners of a cathode ray tube as shown in FIG. 7 (only two arms 33 and 34 shown) instead of employing the magnetic plates 30 and 40 with their respective arms 31, 32 and 41, 42 attached to the support member 23 as shown in FIGS. 4 and 5.

As understood from the above, the leakage magnetic field of the vertical deflection magnetic field is guided by the magnetic substance toward the cone side, causing it to be brought into face to face with the corresponding diagonal line of the CRT screen to permit correction of a "right and left" pincushion distortion even in a color cathode ray tube with a self-convergence type in-line electron guns. In order to make this system more effective a variety of improvements can be imparted to a deflectiion device of a color CRT tube of a self-convergence type in-line electron guns.

For example, a component for pulling beams upward and component for pulling the beams downward is greater at the central portion of the screen than at the diagonal portion thereof due to a pincushion type magnetic field resulting from the arms, tending contrarily to produce a barrel raster distortion. Such accompanying influence can be eliminated by beforehand providing a pincushion magnetic field at the neck section and a barrel magnetic field at the cone section of CRT.

The deflecting device according to this invention can be used not only for a color cathode ray tube having in-line type electron gun assembly but for that having delta type election gun assembly. The deflecting device can also be used with a monochromatic cathode ray tube.

What is claimed is:

1. A deflecting device for cathode-ray tube having a screen comprising deflection means to be mounted on said cathode-ray tube and including a vertical deflection means for causing deflection along an axis by generating a vertical deflection magnetic field, and means for picking up leakage fluxes generated from said vertical deflection means and passing the leakage fluxes directly from a first to a second position, and from a third to a fourth position, said first and second positions corresponding to the two corners of said screen nearest one end of said axis, and said third and fourth positions corresponding to the other two corners of said screen, thereby deforming towards a pincushion-distributed vertical deflection magnetic field that portion of said vertical deflection magnetic field which is generated in a position corresponding to the cone portion of said cathode-ray tube.

2. A deflecting device for color cathode-ray tube having a screen comprising deflection means to be mounted on said color cathode-ray tube and including a vertical deflection means for generating a barrel-distributed deflection magnetic field for causing deflection along an axis and a horizontal deflection coil for generating a pincushion-distributed deflection magnetic field, and means for picking up leakage fluxes generated from said vertical deflection means and passing the leakage fluxes directly from a first to a second position, and from a third to a fourth position, said first and second positions corresponding to the two corners of said screen nearest one end of said axis, and said third and fourth positions corresponding to the other two corners of said screen, thereby deforming towards a pincushion-distributed vertical deflection magnetic field that portion of said barrel-distributed vertical deflection magnetic field which is generated in a position corresponding to the cone portion of said cathode-ray tube.

3. A deflecting device for color cathode-ray tube according to claim 2, wherein said color cathode-ray tube includes an in-line type electron gun assembly.

4. A deflecting device for a color cathode-ray tube comprising a substantially cylindrical core with the diameter of one end larger than that of the other, a deflecting means having first and second vertical deflecting coils facing each other and wound around said core to provide a barrel-distribution deflecting magnetic field and generating a barrel-distribution vertical-deflection magnetic field and a pincushion-distribution horizontal-deflection magnetic field, and a magnetic means having first, second, third and fourth arm portions arranged at the large-diameter end side of said core correspondingly to the four corners of a screen of said cathode-ray tube and extending from the small-diameter end to the large-diameter end of said core for passing leakage fluxes directly from said first to said second arm portions and from said third to said fourth arm portions, said first and second arm portions being disposed nearest said first coil and said third and fourth arm portions being disposed nearest said second coil.

5. A deflecting device according to claim 4, wherein said magnetic member is formed of a pair of magnetic plates so arranged as to cover the facing end portions of said pair of vertical deflecting coils, each said magnetic plate having two out of said four arm portions.

6. A deflecting device according to claim 4, wherein the four arm portions of said magnetic member are formed independently of one another.

7. A deflecting device according to claim 4, 5 or 6, wherein said core is formed of substantially symmetrical first and second core sections, and said pair of vertical deflecting coils are toroidally wound around said first and second core sections respectively.

8. A method for correcting the pincushion raster distortion in a cathode-ray tube having a screen and a vertical deflection means which produces leakage fluxes and causes deflection along an axis, said method comprising the steps of:

picking up said leakage fluxes generated by said vertical deflection means of said cathode-ray tube with pick-up means; and directing said leakage fluxes to pass directly from a first position to a second position about said vertical deflection means corresponding to the two corners of said screen nearest one end of said axis, and to pass directly from a third position to a fourth position about said vertical deflection means, corresponding to the other two corners of said screen, thereby deforming towards a pincushion-distributed vertical deflection magnetic field that portion of said barrel-distributed vertical deflection magnetic field which is generated in a position corresponding to the cone portion of said cathode-ray tube.

* * * * *